United States Patent [19]

Ashida et al.

[11] Patent Number: 4,505,572

[45] Date of Patent: Mar. 19, 1985

[54] ELECTROSTATIC REPRODUCING APPARATUS

[75] Inventors: Hisashi Ashida, Tokyo; Keiichiro Suzuki, Kanagawa, both of Japan

[73] Assignee: Konishiroku Photo Industry Co., Ltd., Tokyo, Japan

[21] Appl. No.: 437,343

[22] Filed: Oct. 28, 1982

[30] Foreign Application Priority Data

Oct. 30, 1981 [JP] Japan ..... 56-172811
Oct. 30, 1981 [JP] Japan ..... 56-172812
Oct. 30, 1981 [JP] Japan ..... 56-172813

[51] Int. Cl.[3] ..... G03G 15/00
[52] U.S. Cl. ..... 355/3 R; 355/14 R
[58] Field of Search ..... 355/3 R, 14 R, 14 SH, 355/14 D, 30 D, 35 H

[56] References Cited

U.S. PATENT DOCUMENTS 3,815,988 6/1974 McVeigh et al. ..... 355/3 R
4,303,332 12/1981 Sakai ..... 355/14 R
4,341,460 7/1982 Kohyama ..... 355/14 SH X

*Primary Examiner*—A. C. Prescott
*Attorney, Agent, or Firm*—James E. Nilles

[57] ABSTRACT

An electrostatic reproducing apparatus characterized in that a sensor unit consisting integrally of at least one light emitting element and one light receiving element is disposed close to the surface of a photosensitive member at a position downstream of the position where the printed sheet of recording paper separates from the photosensitive member. One of the light emitting elements is a visible-light emitting diode for detecting jamming of the sheet of recording paper and the other light emitting element is an infrared-light emitting diode for detecting the toner concentration.

8 Claims, 10 Drawing Figures

ELECTROSTATIC REPRODUCING APPARATUS

BACKGROUND OF THE INVENTION

1. Field of the Invention

This invention relates to an electrostatic reproducing apparatus capable of sensing the jamming of sheets of recording paper after image transfer, and the concentration of the toner.

2. Description of the Prior Art

Apparatus for electrostatic reproduction by an electrophotographic process such as electrophotographic copying machines and certain kinds of facsimile machines are well known. In an apparatus of this kind, an electrostatic image of a document or electrical data is formed on a photosensitive or dielectric member by the use of reflected light obtained by exposing and scanning the document or by optical data prepared on the basis of electrical data signals, and is then developed to form a visible image by a developer containing a toner and the resulting visible image is transferred to recording paper and is then fixed to provide a reproduced image. FIG. 1 shows the construction of an electrophotographic copying machine diagrammatically as an example of this type of electrostatic reproducing apparatus. The document G placed on a document glass table 1 is exposed by an exposure lamp 2 and the light reflected from the document G is projected onto a photosensitive member 5*a* on a rotary drum 5 via mirrors 3*a* and 3*b* and an exposure slit 4, forming an electrostatically charged image of the document G on the photosensitive member 5*a*. In proximity to the rotary drum 5 are disposed a charging electrode 6 for charging the photosensitive member 5*a* uniformly, a developing device 7, a transfer electrode 8, a separation electrode 9 which makes the recording paper easily separatable from the photosensitive member 5*a* after transfer, a separation pawl 10 for separating the recording paper from the photosensitive member 5*a*, a charge-eliminating electrode 11 for eliminating the charge remaining on the photosensitive member 5*a*, and a cleaning device 12 for removing any toner remaining on the photosensitive member 5*a*. Reference numeral 13 represents a jamming sensing means (hereinafter referred to as a "jamming detector") for detecting whether the recording paper is still being carried wound on the photosensitive member 5*a* because of a malfunction in the separation means described above, or the like, by the quantity of light reflected from the surface of the recording paper, anticipating the jamming of the paper in the cleaning device 12 and to prevent such jamming. A reflection type of photo-sensor is used conventionally as the jamming detector 13. The photo-sensor consists of a light-emitting diode emitting infrared light so that incoming external light does not influence it and the charging capacity of the photosensitive member is not reduced by it, and a photo-transistor receiving the reflected light and producing an equivalent electric signal.

The electrostatically charged image formed on the photosensitive member 5*a* is developed by the developing device 7 to produce a visible image, which is then transferred by the transfer electrode 8 to the recording paper P that is fed from a paper feed tray 14 by a paper feeder 15. After transfer, the recording paper P is separated from the photosensitive member 5*a* by the separation electrode 9 in cooperation with the separation pawl 10, is then transferred by a conveyor belt 16 and is heat-fixed by a fixing device 17. The paper P is finally ejected into a receiving tray 18.

If a two-component system developer consisting of a carrier such as iron powder and a colored resin powder used as the toner is used as the developer in the electrophotographic copying machines of the kind described above, the toner in the developer is used up during repeated copying so that the toner concentration and eventually, the density of the reproduced image, gradually drop. Hence, the toner must be replenished in order to keep the reproduced image density constant, and various methods of detecting the toner concentration have therefore been proposed in the past. As a typical example of such methods, a method of detecting the toner concentration by use of an optical sensor is known. According to this method, a plate 19 having a reference density (e.g., an optical reflection density of 1.0) is bonded to the end of the underside of the document glass table 1 as shown in FIG. 2 and this reference density plate 19 is exposed during the exposure step before the document is exposed. (In this drawing, the document table 1 moves in the direction indicated by an arrow.) The electrostatically charged image of the plate is formed on the photosensitive member 5*a* and is developed into a visible image so that the density of the visible image can be detected by an optical sensor (not shown) that is positioned in the proximity of the photosensitive member 5*a*.

A conventional sensor for detecting the toner concentration consists of a light emitting element such as a light emitting diode and a light receiving element such as a phototransistor, and infrared light is used as the detecting light in order to eliminate the influences of external light and to prevent a reduction in the charging capacity of the photosensitive member. It is also known to use this kind of sensor as a jamming detector.

From considerations of the processing system of an electrostatic reproducing apparatus using the electrophotographic process, it is preferable that a single sensor be used both to sense jamming of the paper and to detect the toner concentration because the disposition of two separate sensors results in an increase in the space they occupy and in the number of components. However, there is not a great difference between the sensor output level when a sheet of recording paper remains abnormally wound on the photosensitive member and the sensor output level under the normal condition where paper is not wound on the photosensitive member. Accordingly, if a single sensor is used to detect jamming as well as to detect the toner concentration, the detection is likely to become unreliable under various conditions if the jamming is sensed by judging whether or not the output level exceeds a threshold value. Another problem is that if the sensor is contaminated by toner, the sensor output level drops and jamming detection is no longer possible.

Various materials have been employed for the photosensitive member of electrophotographic copying machines of the kind described above, such as zinc oxide, amorphous selenium, OPC (organic semiconductors) and the like. It is known that if a photosensitive member made of one of these materials is exposed to light for an extended period of time, a phenomenon referred to as the "memory effect" occurs in which the chargeability of the exposed portion of the photosensitive member drops and an electric charge can not be easily induced in that portion. Since conventional electrophotographic copying machines make use of an infrared-light emitting diode as the jamming detection means, degradation of the chargeability of the photosensitive member is as obvious as when visible light is used, but because the light emitting diode is kept lit even during the period in which the reproduction is not being carried out, the surface potential of the photosensitive member is likely to become non-uniform when the apparatus has been in use for an extended period of time, and the quality of the reproduced image is likely to drop. If the light emitting element has directionality, the illumination of the radiated portion becomes so much greater that the degradation of chargeability becomes a critical problem if such a light emitting element is used to sense jamming. Moreover, fluorescent lamps having a reduced power consumption have been used in place of the conventional halogen lamp to save energy and this calls for a photosensitive material having a higher sensitivity. A higher sensitivity of the photosensitive material is also necessary in order to improve the reproducing speed. If the sensitivity of the photosensitive material is improved, the problem of the degradation of chargeability becomes greater.

To cope with these problems, a method has been proposed in which the light emitting element is lit not continuously but intermittently, and the proportion of time that the element is on to the time it is off is suitably adjusted. However, with this method too, the light emitting element must be turned on and off even during the period in which reproduction is not carried out, and a small area of the photosensitive member is undesirably illuminated for a long period when it is not rotating. In order to increase the difference of the output levels of the jamming detection means when jamming occurs and when it does not, a method which uses a visible-light emitting diode has also been proposed. If this method is applied to the above method in which the light emitting element is intermittently turned on and off, however, the problem of the chargeability of the photosensitive member can not be sufficiently solved.

SUMMARY OF THE INVENTION

In order to eliminate the problems with the prior art described above, the present invention makes use of visible light so that changes of the sensor output levels can be made sufficiently large when sensing jamming and the sensing can be effected reliably. To reduce the components and space needed, the present invention makes use of a single integral sensor unit which consists of a light emitting element for jamming detection, a light emitting element for toner concentration detection and a light receiving element which is common to the two light emitting elements.

In order to prevent any degradation of chargeability of the photosensitive member occurring when light is emitted onto the photosensitive member for optical jamming detection, the present invention turns the light emitting elements on at least once after the power source is charged and after a jammed sheet of paper has been removed, and turns the light emitting elements on and off during the reproduction.

DESCRIPTION OF THE PREFERRED EMBODIMENTS

Figure 1:
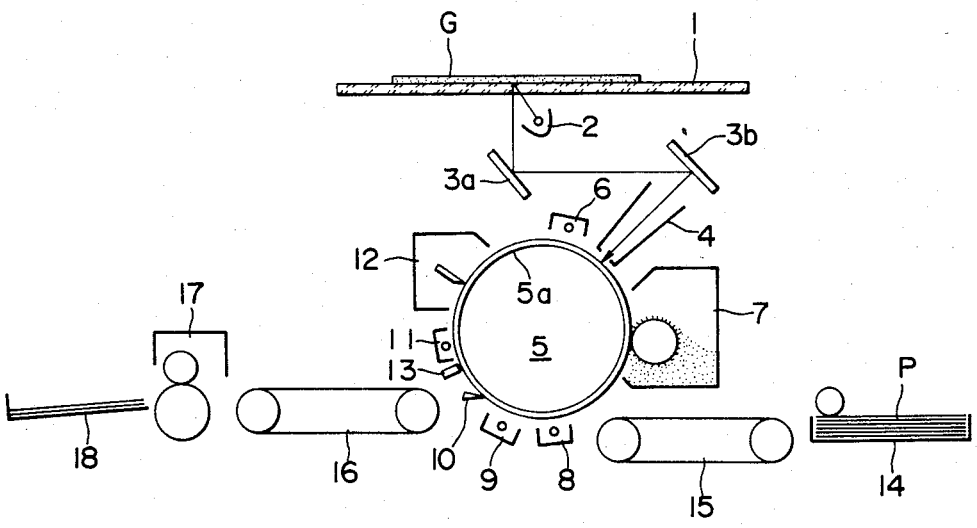
FIG. 1 is a diagram of an electrophotographic copying machine.
Figure 2:
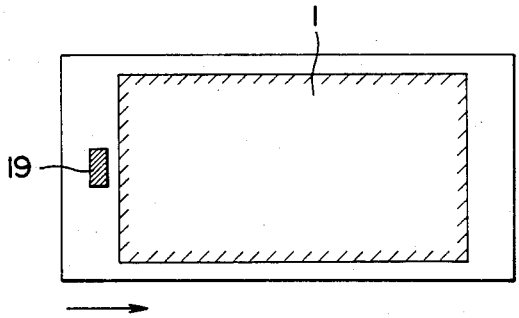
FIG. 2 shows a reference density plate fitted to the underside of the document glass table and forming a part of the toner concentration detection means.
Figure 3:
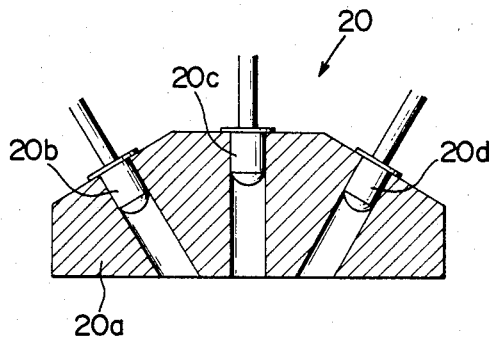
FIG. 3 shows the sensor unit of the electrostatic reproducing apparatus in accordance with the present invention.

FIG. 3 illustrates one embodiment of the sensor unit to be used in an electrostatic reproducing apparatus in accordance with the present invention. The sensor unit 20 consists of an infrared-light emitting diode 20*b* for detecting toner concentration, a visible-light emitting diode 20*c* for sensing jamming, and a photo-transistor 20*d* for receiving the light emitted from these light emitting diodes and reflected from a reference concentration plate 19 and for converting them to electric signals. These semiconductors 20*b*, 20*c* and 20*d* are embedded at predetermined angles in a molded support 20*a*. A preferable angle of disposition of the photo-transistor 20*d* is such that the regular reflected light from the infrared-light emitting diode 20*b* for detecting the toner concentration is readily incident but the regular reflected light from the visible-light emitting diode 20*c* for sensing jamming is not so readily incident. This sensor unit 20 could be disposed at the position of the jamming detector 13 of the electrostatic reproducing apparatus shown in FIG. 1.

Figure 4:
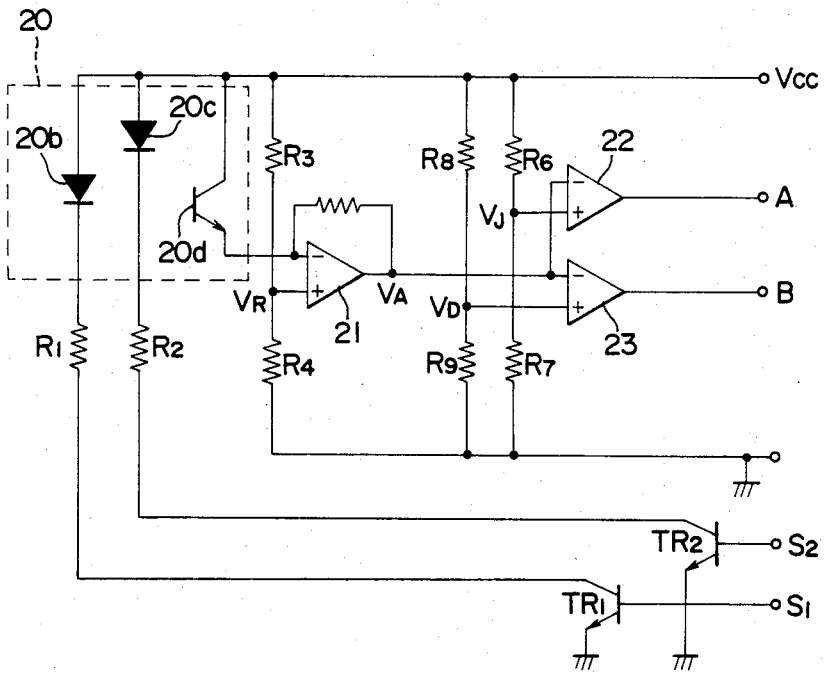
FIG. 4 is a circuit diagram of a detection circuit using the sensor unit in accordance with the present invention.

FIG. 4 is the circuit diagram of the detection circuit using the sensor unit described above.

The sensor unit 20 consists of the infrared-light emitting diode 20*b*, the visible-light emitting diode 20*c* and the photo-transistor 20*d*. The anodes of these light emitting diodes 20*b*, 20*c* and the collector of the photo-transistor 20*d* are connected in common to a power source $V_{CC}$. The cathodes of the light emitting diodes are connected to the collectors of driving transistors $TR_1$ and $TR_2$ via resistors $R_1$ and $R_2$, respectively. The emitter of the photo-transistor 20*d* is connected to the inversion input terminal of an operational amplifier 21. The emitters of transistors $TR_1$ and $TR_2$ are grounded and light emitting diode driving signals $S_1$ and $S_2$ respectively are applied to their bases. The non-inversion input terminal of the operational amplifier 21 is connected to the junction between voltage dividing resistors $R_3$ and $R_4$ that are interposed between the power source $V_{CC}$ and ground. The output terminal of the operational amplifier 21 is connected to the inversion input terminals of comparators 22 and 23 and also to its own inversion input terminal via a resistor $R_5$. The non-inversion input terminal of comparator 22 is connected to the junction (voltage $V_J$) between voltage dividing resistors $R_6$ and $R_7$ that are interposed between the power source $V_{CC}$ and ground. The non-inversion input terminal of comparator 23 is connected to the junction (voltage $V_D$) between similar voltage dividing resistors $R_8$ and $R_9$.

Figure 5:
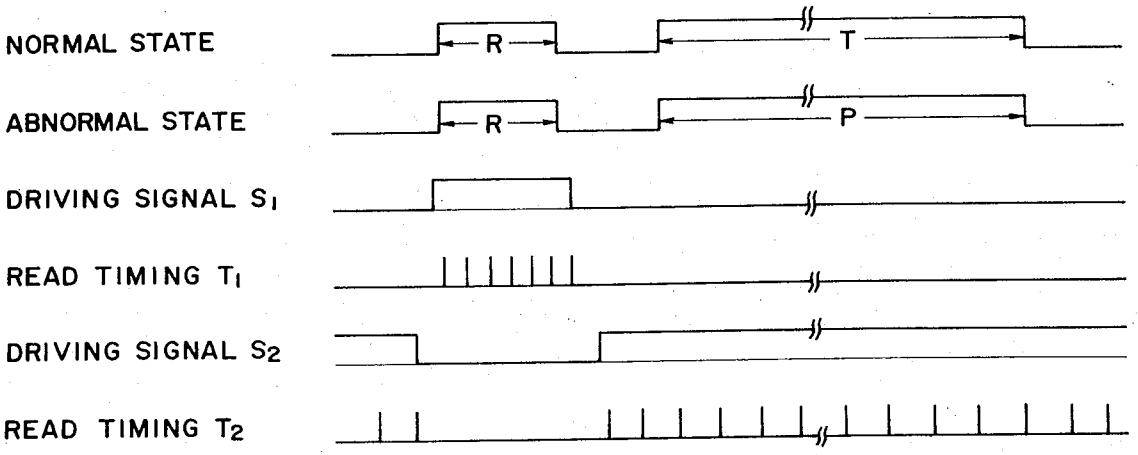
FIG. 5 is a timing chart showing the operation of the detection circuit.

The operation of the sensing circuit described above will now be explained with reference to FIG. 5. During the normal operation of the apparatus (without jamming), the rotary drum 5 (see FIG. 1) rotates and when the visible image R (primary image) of the reference density plate 19 reaches the position of the sensor unit 20, the driving signal $S_1$ is applied to transistor $TR_1$ so that the infrared-light emitting diode 20*b* emits light. The photo-transistor 20*d* receives the light reflected from the visible image R of the reference density plate 19 and the operational amplifier 21 produces a voltage $V_A$ proportional to the density and applies it to comparators 22 and 23. Comparator 23 compares this voltage with a toner concentration reference voltage $V_D$ that is determined in advance by the voltage dividing resistors $R_8$ and $R_9$. If the concentration detected is below a reference toner concentration, the voltage $V_A$ drops and a high signal is obtained from terminal B. However, if the concentration is above the reference toner concentration, a low signal is obtained from terminal B. The toner concentration signals are read with the timing $T_1$ shown in FIG. 5.

After a predetermined period of time has passed, the image area T on the photosensitive member 5*a* after image transfer reaches the position of the sensor unit 20. The driving signal $S_2$ is applied to transistor $TR_2$ with this timing so that the visible-light emitting diode 20*c* emits light. The photo-transistor 20*d* receives the light reflected from the photosensitive member 5*a* and the output of the operational amplifier 21 is applied to comparators 22 and 23. If a sheet of recording paper remains wound around the rotary drum 5 because it has not been successfully separated therefrom, the output $V_A$ of the operational amplifier 21 drops and becomes lower than a jamming detection reference voltage $V_J$ that is determined by the voltage dividing resistors $R_6$ and $R_7$. Hence, a high signal is obtained from terminal A of comparator 22. If the separation of the recording paper is normal, on the other hand, the output $V_A$ of the operational amplifier 21 does not drop so its level does not fall below the voltage $V_J$. Hence, a low signal is obtained from terminal A. This jamming detection signal is read with the timing $T_2$ shown in FIG. 5. In this embodiment, the infrared-light emitting diode for toner concentration detection and the visible-light emitting diode for jamming detection are driven by d.c. current but they could also be pulse-lit to reduce the fatigue of the phtosensitive member.

Figure 6A:
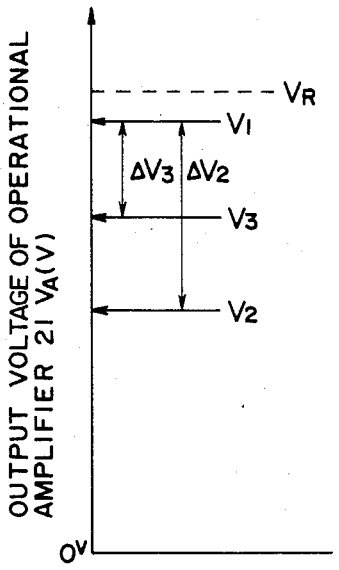
FIGS. 6(*a*) and 6(*b*) are graphs showing the jamming detection performance of the sensor unit of the present invention compared with the jamming detection performance of a conventional sensor unit.
Figure 6B:
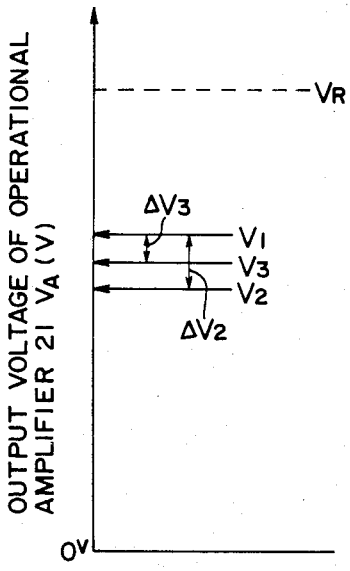

FIG. 6 shows the jamming detection performance of the sensor unit of the present invention compared with the performance of a conventional sensor unit. FIG. 6(*a*) shows the performance of the sensor unit of the present invention and FIG. 6(*b*) shows the performance of a conventional jamming detector consisting of an infrared-light emitting diode and a photo-transistor. These diagrams show the performance related to the changes in the output voltage $V_A$ of the operational amplifier 21 in the detection circuit shown in FIG. 4. As can be seen from the graphs, the optical unit of the present invention provides a greater difference $V_2$ in output level between the voltage $V_1$ which is the voltage $V_A$ for the photosensitive member and the voltage $V_2$ which is the voltage $V_A$ for the recording paper, and a greater difference $V_3$ between $V_1$ and $V_3$ which is the voltage $V_A$ for a second document and consequently, the jamming detection performance can be improved by these differences.

It is assumed that when visible light is employed, the difference in output levels between the photosensitive member ($V_1$) and the recording paper ($V_2$) or the second document ($V_3$) is greater than when infrared light is used, for the following reasons.

Light emitted from the light emitting diode onto the photosensitive member 5*a* is partially absorbed if there is residual toner on the photosensitive member 5*a*. Light directly emitted onto the photosensitive member 5*a* is partially reflected by the photosensitive member 5*a* and the rest of the light passes through the photosensitive member and is reflected by the surface of the rotary drum 5. These two kinds of reflected light are mixed and received by the photo-transistor. On the other hand, when a sheet of recording paper is wound around the photosensitive member 5*a*, most of the light emitted by the light emitting diode is reflected by the recording paper so that hardly any reaches the photosensitive member through the paper.

Figure 7:
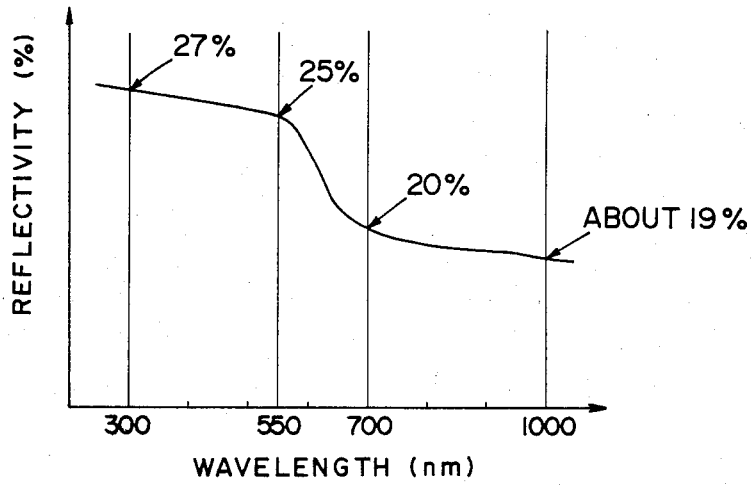
FIG. 7 is a diagram showing the relationship between the wavelength of light shone on the photosensitive member and its reflectivity.
Figure 8:
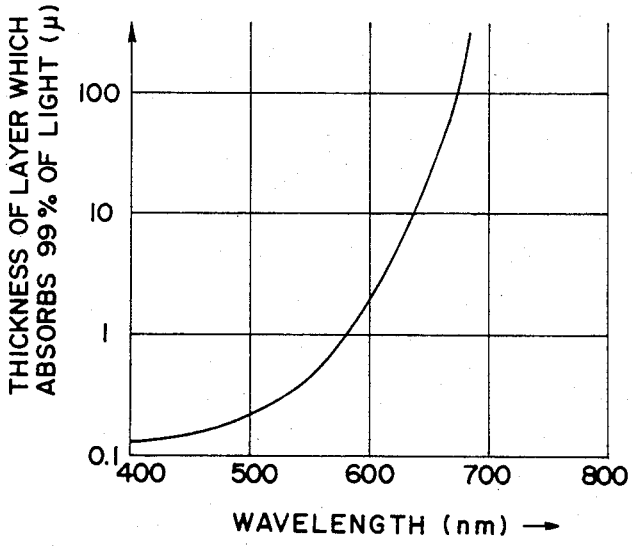
FIG. 8 is a diagram showing the relationship between the wavelength of light emitted on the photosensitive member and the thickness of a layer that absorbs 99% of the light.

The relationship between the wavelength of the light and its reflectivity, and the relationship between the wavelength and the thickness of a layer which absorbs 99% of the light, when amorphous selenium is used as the photosensitive member 5*a*, are shown in FIGS. 7 and 8, respectively. As can be seen from these graphs, the reflectivity is about 20% for light within the range of wavelengths of about 700 to 1,000 nm, and if the thickness of the photosensitive member 5*a* is at least 30–40 microns most of the visible light (in the range of wavelengths of 400 to 700 nm) is absorbed by the photosensitive member. Accordingly, if the wavelength of the emitted light is within the visible light range as in the present invention, the light reflected from the drum surface is much reduced and the difference between the voltage output due to light reflected from the photosensitive member 5*a* and the voltage output due to light reflected from the recording paper can be increased similarly, as shown in FIG. 6(*a*). In contrast, when infrared light is used as in the prior art apparatus, the difference between light reflected from the photosensitive member and light reflected from the recording paper, and hence, the difference between their voltage output levels, is reduced as shown in FIG. 6(*b*). Accordingly, the jamming detection performance is inferior.

As described above, the light emitting elements in the sensor unit of the present invention may be lit either by a d.c. power source or by a pulse of a short duration. Besides the arrangement described above, the light emitting elements and the light receiving element may be disposed at such angles that the regular reflected visible light from the jamming sensing light emitting diode and the infrared light from the toner concentration detection light emitting diode are not readily incident. Though the foregoing embodiment uses a reference density plate as a means for detecting the toner concentration, the present invention can be embodied by the use of other means. The light emitting elements of the sensor unit are not limited to two elements, in particular, but there may be a greater number. In such a case, the wavelength of the light emitted from such light emitting elements can be changed as needed in accordance with the object of the detection.

As described in the foregoing, the present invention makes use of a plurality of light emitting elements and a single light receiving element for receiving the light reflected back from the light emitting elements as one unit. Accordingly, the space it fills as well as the number of components can be reduced. Because the visible-light emitting element is used for detecting jamming and the infrared light emitting element for detecting the toner concentration, the difference in output levels of the light receiving element when detecting jamming is greater than that when infrared light is used for jamming detection as in the prior art. For this reason, the jamming detection performance can be improved.

Figure 9:
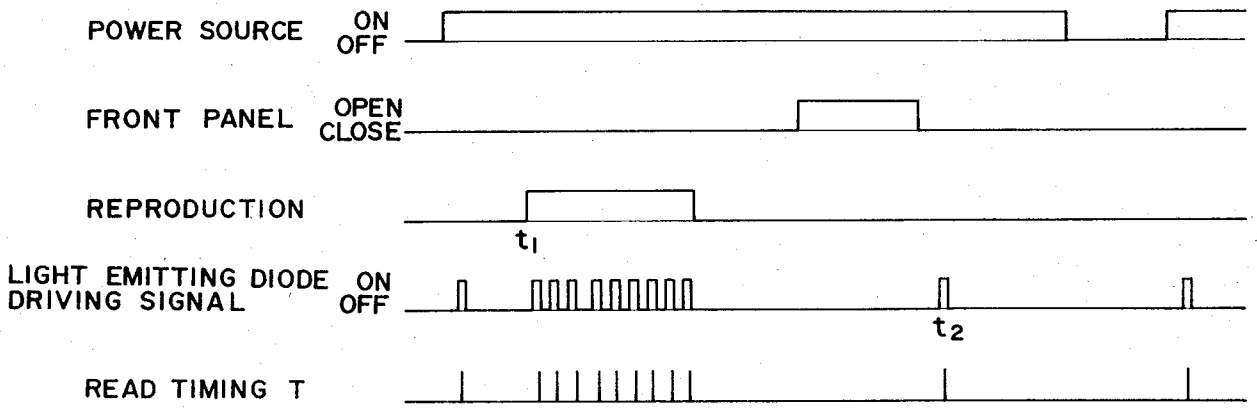
FIG. 9 is a timing chart showing the timing of the light emitting diodes in another embodiment of the present invention.

FIG. 9 shows the timing for lighting the light emitting diodes in another embodiment of the present invention.

Light emitting diode 20*b* of the jamming detector 20 is first lit at least once when the power switch of the reproducing apparatus is turned on. This is to confirm that if jamming occurred during the previous reproduction cycle, the jammed paper has been completely removed and the next reproduction cycle is now ready to start. After the reproduction is started at time $t_1$, light emitting diode 20*b* is turned on and off by a series of pulses. Jamming detection is effected on the basis of the output from the jamming detector 20 in this instance, and the sensing operation is the same as that explained above with reference to FIG. 4. If jamming is detected during the reproduction, the reproduction cycle is interrupted and the front panel (not shown) at the front of the reproducing apparatus is opened so as to remove the jammed paper. At time $t_2$ after the front panel of the apparatus is closed, light emitting diode 20*b* is lit at least once. This is to confirm that the jammed paper has been removed and thus that the jamming no longer exists. The jamming detection output is applied to the control unit and the reading of the signals in this embodiment is effected with timing which is synchronized with the light emitting diode driving signal S.

In this embodiment, the light emitting diode can emit either visible light or infrared light. The on-off period of the driving signal S for turning the light emitting diode on and off during the reproduction, the period of the pulsed driving signal, and the ratio of the on-time to the off-time, the duty ratio, can be selected as needed according to the type of photosensitive material used and the characteristics of the light emitting diodes, and can be altered to adjust for long-term use of the photosensitive member.

In the embodiment above, the light emitting diode is lit at least once after the power switch is turned on and after the jammed paper is removed, and is turned on and off repeatedly during the reproduction. Accordingly, any drop in chargeability can be prevented even for a highly sensitive photosensitive material and the quality of the reproduced image can be improved. This results in the additional advantage that if a highly sensitive photosensitive material is used, the original can even be illuminated by a fluorescent lamp and the reproduction speed can be improved. Although methods of improving the jamming detection performance by use of a light emitting diode for emitting visible light have been proposed, the present invention can effectively solve the problem of the degradation of chargeability of the photosensitive material resulting from the illumination by visible light.

What is claimed is:

1. An electrostatic reproducing apparatus comprising a photosensitive member having a surface which moves orbitally to carry points thereon successively past a position where a recording paper is separated from said surface and a position at which a cleaning member acts upon the photosensitive member, characterized by: a light-emitting element near said surface of the photosensitive member for emitting a visible light to said surface as it moves between said positions, and a light receiving element for receiving light from said light emitting element that is reflected from said surface to thereby detect jamming.

2. An electrostatic reproducing apparatus comprising a photosensitive member having a surface which moves orbitally to carry points thereon successively past a position where a recording paper is separated from said surface and a position at which a cleaning member acts upon the photosensitive member, characterized by: a sensor unit comprising a plurality of light emitting elements and one light receiving element for receiving light emitted from said light emitting elements, said unit being disposed near said surface and being so arranged that light from said light emitting elements falls on said surface between said positions and is reflected therefrom to said light receiving element.

3. The electrostatic reproducing apparatus of claim 2 wherein each of said light emitting elements emits light having a different wavelength from that emitted by the others.

4. The electrostatic reproducing apparatus of claim 3 wherein one of said light emitting elements emits visible light, for detecting jamming of recording paper, and another of said light emitting elements comprises an infra-red light emitting diode for detecting toner concentration.

5. The electrostatic reproducing apparatus of claim 4 wherein said one light emitting element, for detecting jamming, is lit at least once after the power source of said apparatus is turned on, and after the opening and closing of a front panel.

6. The electostatic reproducing apparatus of claim 4 wherein said light receiving element is so disposed that it hardly receives visible light reflected from said surface that is emitted from said one light emitting member.

7. An electrostatic reproducing apparatus comprising a photosensitive member having a surface which moves orbitally to carry points thereon successively past a position where a recording paper is separated from said surface and a position at which a cleaning member acts upon the photosensitive member, and means for producing on an area of said surface that is not contacted by recording paper a visible image having a density corresponding to prevailing toner concentration, said apparatus being characterized by: a first light emitter for emitting infra-red light, located near said surface and arranged to direct radiation onto said area when the same is between said positions; a second light emitter for emitting visible light, located near said surface and arranged to direct visible light onto a portion of said surface that is between said positions; a light sensor responsive to infra-red radiation and to visible light, located near said surface and arranged to detect light from said first and second light emitters that is reflected from said surface; first circuit means operative during a period in each orbit of the photosensitive member when said area is between said positions for connecting said first light emitter and said light sensor in a first detecting circuit for detecting prevailing toner concentration; and second circuit means operative during another period in each orbit of the photosensitive member for connecting said second light emitter and said light sensor in a second detecting circuit for detecting any failure of recording paper to be separated from the photosensitive member.

8. The electrostatic reproducing apparatus of claim 7, wherein each of said first and said second circuit means is operative intermittently, at regular intervals, during its period of operativeness.

* * * * *